US006703358B1

(12) United States Patent
Aubay et al.

(10) Patent No.: US 6,703,358 B1
(45) Date of Patent: Mar. 9, 2004

(54) CLEANING COMPOSITION FOR HARD SURFACES

(75) Inventors: Eric Aubay, Le Perreux sur Marne (FR); Gladys Saliba Gabriel, Alamo, CA (US); Dominic Yeung, Mississauga (CA)

(73) Assignee: Rhodia Chimie, Boulogne Billancourt Cedex (FR)

( * ) Notice: Subject to any disclaimer, the term of this patent is extended or adjusted under 35 U.S.C. 154(b) by 0 days.

(21) Appl. No.: 09/616,021

(22) Filed: Jul. 13, 2000

(51) Int. Cl.[7] ..... C11D 3/37; C11D 1/62; C11D 1/75

(52) U.S. Cl. ..... 510/434; 510/229; 510/238; 510/240; 510/241; 510/243; 510/244; 510/476; 510/504

(58) Field of Search ..... 510/229, 238, 510/240, 241, 243, 244, 434, 476, 504; 134/38, 39, 40, 42

(56) References Cited

U.S. PATENT DOCUMENTS

| | | | | | |
|---|---|---|---|---|---|
| 4,784,789 A | * | 11/1988 | Jeschke et al. | ..... | 252/174.23 |
| 4,814,101 A | * | 3/1989 | Schieferstein et al. | . | 252/174.23 |

FOREIGN PATENT DOCUMENTS

| | | | | | |
|---|---|---|---|---|---|
| DE | 2848723 | * | 6/1979 | ..... | C08F/220/56 |
| DE | 19649288 | * | 6/1998 | ..... | C11D/3/37 |
| EP | 522756 | * | 1/1993 | ..... | A61K/7/48 |
| EP | 560519 | * | 9/1993 | ..... | C11D/3/37 |
| EP | WO 98/44012 | * | 10/1998 | ..... | C08F/220/06 |
| EP | 894489 | * | 2/1999 | ..... | A61K/7/00 |
| EP | WO 99/24004 | * | 5/1999 | ..... | A61K/7/06 |

* cited by examiner

*Primary Examiner*—Brian P. Mruk

(57) ABSTRACT

This invention relates to a cleaning composition for hard surfaces, comprising at least one surfactant and a water-soluble or water-dispersible copolymer comprising, in the form of polymerized units:

(a) at least one monomeric compound of general formula I;

(b) at least one hydrophilic monomer chosen from $C_3$–$C_8$ carboxylic acids containing monoethylenic unsaturation, anhydrides thereof and water-soluble salts thereof;

(c) optionally, at least one hydrophilic monomeric compound containing ethylenic unsaturation, of neutral charge, bearing one or more hydrophilic groups, which is copolymerizable with (a) and (b).

6 Claims, No Drawings

CLEANING COMPOSITION FOR HARD SURFACES

The present invention relates to a cleaning composition for treating public, domestic or industrial hard surfaces, in particular of ceramic, tile or glass type, which is aimed at giving these surfaces hydrophilic properties.

The invention relates more particularly to a cleaning composition for treating such a surface which is capable of giving this surface long-lasting hydrophilic properties so as to avoid the subsequent presence of marks due in particular to the drying of drops of water deposited on the said surface.

Commercial detergent formulations clean public, domestic or industrial hard surfaces efficiently. They generally consist of an aqueous solution of surfactants, in particular of nonionic and anionic surfactants, of alcohol(s) to facilitate drying, and optionally of sequestering agents and bases to adjust the pH. A major defect of these detergent formulations is that the subsequent contact of the hard surface with water can lead to the presence of marks on drying. This contact with water after applying detergent can originate, for example, from rainwater in the case of windows, mains water on a bathroom tile, or rinsing water when the cleaning requires a rinsing. They can also originate from the air-drying of washing-up crockery in the case of detergent formulations for washing up by hand, or from the drying of washing-up crockery in an automatic machine when it is a case of dishwasher detergent. In the case of doing the washing-up in an automatic machine, the said formulation can either be used in the cleaning cycle (detergent formulation) or during the rinsing cycle (rinsing liquid).

The presence of marks or stains left on hard surfaces by water which comes into contact with them is due to the phenomenon of contraction of the drops of water on contact with the hard surface, which, during the subsequent drying, leave marks on the surface which reproduce the original shapes and dimensions of the drops.

No satisfactory solution to this problem exists at the present time.

To solve the problem posed by the retraction and drying of drops of water, the solution consists in increasing the hydrophilicity of the surface in order to obtain the smallest possible contact angle between the hard surface to be treated and the drop of water.

The inventors' studies which led to the present invention have determined that this problem can be solved in an effective and long-lasting manner by incorporating in the conventional cleaning compositions for hard surfaces, a water-soluble or water-dispersible organic polymer compound which has both a function of interaction with the surface to be treated and a function giving this surface a hydrophilic nature and having certain specific properties.

A first subject of the invention consists of a cleaning composition for hard surfaces comprising at least one surfactant and at least one water-soluble or water-dispersible copolymer comprising, in the form of polymerized units:

(a) at least one monomeric compound of general formula I:

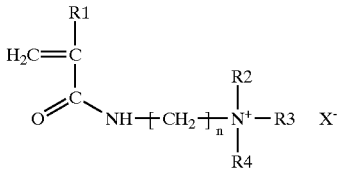

in which $R_1$ is a hydrogen atom or a methyl group, preferably a methyl group;

$R_2$, $R_3$ and $R_4$ are linear or branched $C_1$–$C_4$ alkyl groups;

n represents an integer from 1 to 4, in particular the number 3;

X represents a counterion which is compatible with the water-soluble or water-dispersible nature of the polymer;

(b) at least one hydrophilic monomer chosen from $C_3$–$C_8$ carboxylic acids containing monoethylenic unsaturation, anhydrides thereof and water-soluble salts thereof;

(c) optionally at least one hydrophilic monomeric compound containing ethylenic unsaturation, of neutral charge, bearing one or more hydrophilic groups, which is copolymerizable with (a) and (b);

the average charge Q on the copolymer defined by the equation:

$$Q = \frac{[a] - [b]\Gamma}{[a]}$$

in which [a] represents the molar concentration of monomer (a);

in which [b] represents the molar concentration of monomer (b); and and r represents the rate of neutralization of monomers (b) defined by:

$$\Gamma = \frac{[COO^-]}{[COOH] + [COO^-]}$$

in which [COOH] and $[COO^-]$ represent, respectively, the molar concentrations of monomers (b) in carboxylic acid and carboxylate form at the pH at which the cleaning composition is used, being greater than 0 and possibly going down to 0.4, advantageously down to 0.2. The molar ratio (a)/(b) is advantageously between 25/75 and 70/30.

The molar ratio c/(a+b+c) is advantageously between 0 and 40/100, preferably between 10/100 and 30/100.

The copolymer according to the invention is preferably a random copolymer.

The average charge Q on the said copolymer at the pH of the cleaning composition may be determined by any known means, in particular by assay using a polyvinyl sulphate solution or by zetametry.

The monomer (a) gives the copolymer properties of interaction with the surface to be treated, in particular allowing anchoring of the copolymer to this surface.

The monomer (b) and optionally the monomer (c) give the copolymer hydrophilic properties which, after anchoring the copolymer to the surface to be treated, are transmitted to this surface.

The expression "long-lasting stain-resistant or mark-resistant properties" means that the treated surface contains these properties over time, which includes after subsequent contact with water, whether this is rainwater, mains water or rinsing water containing or not containing rinsing products.

This hydrophilic property of the surface moreover reduces the formation of mist on the surface; this benefit can be exploited in cleaning formulations for glass panels and mirrors, in particular in bathrooms.

Furthermore, when a surface is treated using a copolymer according to the invention, the rate at which this surface dries, immediately after the polymer has been applied but also after subsequent and repeated contact with an aqueous medium, is very significantly improved.

The copolymer according to the invention advantageously has a weight-average molecular mass of at least 1000, advantageously of at least 10,000; it can be up to 20,000,000, advantageously up to 10,000,000.

Except where otherwise mentioned, when the expression "molecular mass" is used, this will be the weight-average molecular mass, expressed in g/mol. This may be determined by aqueous gel permeation chromatography (GPC) or measurement of the intrinsic viscosity in 1N $NaNO_3$ solution at 30° C.

The preferred monomer (a) is MAPTAC of the following formula:

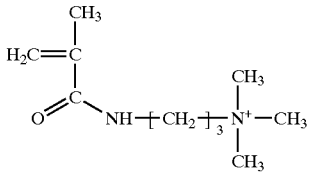

Among the preferred monomers (b) which may be mentioned are acrylic acid, methacrylic acid, α-ethacrylic acid, β,β-dimethylacrylic acid, methylene-malonic acid, vinylacetic acid, allylacetic acid, ethylidineacetic acid, propylidineacetic acid, crotonic acid, maleic acid, fumaric acid, itaconic acid, citraconic acid, mesaconic acid, N-methacroylalanine, N-acryloylhydroxyglycine, and anhydrides and alkali metal salts and ammonium salts thereof.

Among the monomers (c) which may be mentioned are acrylamide, vinyl alcohol, $C_1$–$C_4$ alkyl esters of acrylic acid and of methacrylic acid, Cl–$C_4$ hydroxyalkyl esters of acrylic acid and of methacrylic acid, in particular ethylene glycol and propylene glycol acrylate and methacrylate, polyalkoxylated esters of acrylic acid and of methacrylic acid, in particular the polyethylene glycol and polypropylene glycol esters.

X is any suitable counteranion which is compatible with the water-soluble or water-dispersible nature of the copolymer, in particular a halide, sulphate, hydrogen sulphate, phosphate, citrate, formate or acetate anion.

The copolymers of the invention can be obtained according to the known techniques for the radical-mediated polymerization of ethylenically unsaturated monomers.

The cleaning compositions according to the invention advantageously have a water-soluble or water-dispersible copolymer/surfactant weight ratio of between 1/2 and 1/100, preferably between 1/5 and 1/50.

One copolymer which is particularly preferred is as follows:

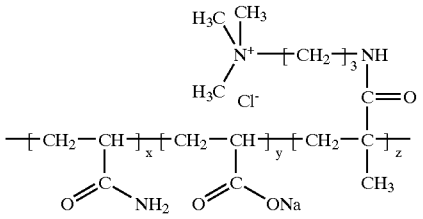

in which the sum of x+y+z is equal to 100%, x, y and z representing the molar percentages of units derived, respectively, from acrylamide, from acrylic acid and from MAPTAC in the copolymer the ratio y/z is from 25/75 to 70/30, and x is between 0 and 40%, preferably between 10 and 30%.

The said copolymer can be introduced into a formulation for treating hard surfaces in a content of between 0.001% and 10% by weight relative to the total weight of the formulation, depending on the concentration of active ingredients in the composition.

The composition according to the invention comprises at least one surfactant. This is advantageously an anionic and/or nonionic surfactant. It can also be a cationic, amphoteric or zwitterionic surfactant.

Among the anionic surfactants which may be mentioned in particular are soaps such as salts of $C_8$–$C_{24}$ fatty acids, for example salts of fatty acids derived from coconut and from tallow;

alkylbenzenesulphonates, in particular alkylbenzenesulphonates of a linear C8–$C_{13}$ alkyl in which the alkyl group comprises from 10 to 16 carbon atoms, alcohol sulphates, ethoxylated alcohol sulphates, hydroxyalkyl sulphonates; alkyl sulphates and sulphonates, in particular of $C_{12}$–$C_{16}$ alkyl, monoglyceride sulphates, and condensates of fatty acid chlorides with hydroxyalkylsulphonates.

Anionic surfactants that are advantageous are, in particular:

alkylester sulphonates of formula R—CH($SO_3$M)—COOR', in which R represents a $C_{8-20}$, preferably $C_{10}$–$C_{16}$, alkyl radical, R' represents a $C_1$–$C_6$, preferably $C_1$–$C_3$, alkyl radical and M represents an alkali metal (sodium, potassium or lithium) cation, a substituted or unsubstituted ammonium (methyl-, dimethyl-, trimethyl-, tetramethylammonium, dimethylpiperidinium, etc.) or an alkanolamine (monoethanolamine, diethanolamine, triethanolamine, etc.) derivative. Mention may be made most particularly of methyl ester sulphonates in which the radical R is $C_{14}$–$C_{16}$;

alkyl sulphates of formula $ROSO_3M$, in which R represents a $C_5$–$C_{24}$, preferably $C_{10}$–$C_{18}$, alkyl or hydroxyalkyl radical, M representing a hydrogen atom or a cation of the same definition as above, as well as the ethoxylenated (EO) and/or propoxylenated (PO) derivatives thereof containing on average from 0.5 to 30 and preferably from 0.5 to 10 EO and/or PO units;

alkylamide sulphates of formula RCONHR'$OSO_3$M, in which R represents a $C_2$–$C_{22}$, preferably $C_6$–$C_{20}$, alkyl radical, R' represents a $C_2$–$C_3$ alkyl radical, M representing a hydrogen atom or a cation of the same definition as above, as well as the ethoxylenated (EO) and/or propoxylenated (PO) derivatives thereof, containing on average from 0.5 to 60 EO and/or PO units;

salts of saturated or unsaturated $C_8$–$C_{24}$, preferably $C_{14}$–$C_{20}$, fatty acids, $C_9$–$C_{20}$ alkylbenzenesulphonates, primary or secondary $C_8$–$C_{22}$ alkylsulphonates, alkylglyceryl sulphonates, the sulphonated polycarboxylic acids described in GB-A-1 082 179, paraffin sulphonates, N-acyl N-alkyltaurates, alkylphosphates, isethionates, alkylsuccinamates, alkylsulphosuccinates, sulphosuccinate monoesters or diesters, N-acyl sarcosinates, alkylglycoside sulphates and polyethoxycarboxylates, the cation being an alkali metal (sodium, potassium or lithium), a substituted or unsubstituted ammonium residue (methyl-, dimethyl-, trimethyl- or tetramethylammonium, dimethylpiperidinium, etc.) or an alkanolamine (monoethanolamine, diethanolamine, triethanolamine, etc.) derivative;

alkyl or alkylaryl phosphate esters such as the products Rhodafac RA600, Rhodafac PA15 or Rhodafac PA23 sold by the company Rhodia.

Among the nonionic surfactants which may be mentioned in particular are alkylene oxide condensates, in particular condensates of ethylene oxide with alcohols, polyols, alkylphenols, fatty acid esters, fatty acid amides and fatty amines; amine oxides, sugar derivatives such as alkylpolyglycosides or fatty acid esters of sugars, in particular sucrose monopalmitate; long-chain tertiary phosphine oxides; dialkyl sulphoxides; block copolymers of polyoxyethylene and of polyoxypropylene; polyalkoxylated sorbitan esters; fatty esters of sorbitan, poly(ethylene oxides) and fatty acid amides modified so as to give them a hydrophobic nature (for example fatty acid mono- and diethanolamides containing from 10 to 18 carbon atoms).

Mention may be made most particularly of

- polyoxyalkylenated (polyethoxyethylenated, polyoxypropylenated or polyoxybutylenated) alkyl phenols in which the alkyl substituent is $C_6$–$C_{12}$ and containing from 5 to 25 oxyalkylene units; by way of example, mention may be made of Triton X-45, X-114, X-100 or X-102 sold by Rohm & Haas Co.;
- glucosamides, glucamides and glycerolamides;
- polyoxyalkylenated C8–$C_{22}$ aliphatic alcohols containing from 1 to 25 oxyalkylene (oxyethylene or oxypropylene) units. By way of example, mention may be made of Tergitol 15-S-9 and Tergitol 24-L-6 NMW sold by Union Carbide Corp., Neodol 45-9, Neodol 23-65, Neodol 45-7 and Neodol 45-4 sold by Shell Chemical Co., and Rhodasurf IDO60, Rhodasurf LA90 and Rhodasurf IT070 sold by the company Rhodia;
- amine oxides such as ($C_1$–$C_{18}$)alkyldimethylamine oxides and ($C_8$–$C_{22}$)alkoxyethyldihydroxyethylamine oxides;
- the alkylpolyglycosides described in US-A-4 565 647;
- $C_8$–$C_{20}$ fatty acid amides;
- ethoxylated fatty acids;
- ethoxylated amines.

Cationic surfactants are, in particular, alkylammonium salts of formula $R^1R^2R^3R^4N^+X^-$ in which

- $X^-$ represents a halide, $CH_3SO_4^-$ or $C_2H_5SO4^-$ ion
- $R^1$ and $R^2$ are identical or different and represent a $C_1$–$C_{20}$ alkyl radical or an aryl or benzyl radical
- $R^3$ and $R^4$ are identical or different and represent a $C_1$–$C_{20}$ alkyl radical, an aryl or benzyl radical or an ethylene oxide and/or propylene oxide condensate $(CH_2CH_2O)_x$-$(CH_2CHCH_3O)_y$-H, in which x and y range from 0 to 30 and are never both zero, such as cetyltrimethylammonium bromide, Rhodaquat® TFR sold by the company Rhodia.

Examples of zwitterionic surfactants comprise aliphatic quaternary ammonium derivatives, in particular 3-(N,N-dimethyl-N-hexadecylammonio)propane 1-sulphonate and 3-(N,N-dimethyl-N-hexadecylammonio)-2-hydroxypropane 1-sulphonate.

Examples of amphoteric surfactants comprise betaines, sulphobetaines and carboxylates and sulphonates of fatty acids and of imidazole.

The following surfactants are preferred:

- alkyldimethylbetaines, alkylamidopropyldimethylbetaines, alkyldimethylsulphobetaines or alkylamidopropyldimethylsulphobetaines such as Mirataine CBS sold by the company Rhodia, and condensation products of fatty acids and of protein hydrolysates;
- alkylamphoacetates or alkylamphodiacetates in which the alkyl group contains from 6 to 20 carbon atoms;
- amphoteric derivatives of alkylpolyamines, such as Amphionic XL® sold by Rhodia and Ampholac 7T/X® and Ampholac 7C/X® sold by Berol Nobel.

Additional examples of suitable surfactants are compounds generally used as surfactants denoted in the well-known manuals "Surface Active Agents", volume I by Schwartz and Perry, and "Surface Active Agents and Detergents", volume II by Schwartz, Perry and Berch.

The surfactants may be present in a proportion of from 0.005% to 60%, in particular from 0.5% to 40%, by weight depending on the nature of the surfactant(s) and on the purpose of the cleaning composition.

Among the other common additives forming part of the formulation of the detergent compositions, mention may be made of:

in particular for washing in a dishwasher

- organic "builders" (detergent adjuvants for improving the surface properties of surfactants) such as:
  - organic phosphonates, such as those of the range Dequest® from Monsanto (in a proportion of from 0% to 2% relative to the total weight of the detergent composition expressed as solids in the case of a dishwasher composition);
  - polycarboxylic acids or water-soluble salts thereof and water-soluble salts of carboxylic polymers or copolymers, such as
    - polycarboxylate or hydroxypolycarboxylate ethers
    - polyacetic acids or salts thereof (nitriloacetic acid, N,N-dicarboxymethyl-2-aminopentane dioic acid, ethylenediaminetetraacetic acid, diethylenetriamine-pentaacetic acid, ethylenediaminetetraacetates, nitrilotriacetates such as Nervanaid NTA $Na_3$ sold by the company Rhodia, and N-(2-hydroxyethyl)-nitrilodiacetates), (in a proportion of from 0% to 10% relative to the total weight of the detergent composition expressed as solids in the case of a dishwasher composition);
    - salts of ($C_5$–$C_{20}$)alkylsuccinic acids
    - carboxylic polyacetal esters
    - polyaspartic or polyglutamic acid salts
    - citric acid, gluconic acid or tartaric acid or salts thereof (in a proportion of from 0% to 10% relative to the total weight of the detergent composition expressed as solids in the case of a dishwasher composition);
- inorganic "builders" (detergent adjuvants for improving the surface properties of surfactants) such as:
  - alkanolamine, ammonium or alkali metal polyphosphates such as Rhodiaphos HPA3.5 sold by the company Rhodia (in a proportion of from 0% to 70% relative to the total weight of detergent composition expressed as solids in the case of a dishwasher composition);
  - alkali metal pyrophosphates
  - zeolites;
  - silicates (in an amount which can be up to 50% approximately relative to the total weight of the said detergent composition expressed as solids in the case of a dishwasher composition);
  - alkali metal or alkaline-earth metal borates, carbonates, bicarbonates and sesquicarbonates (in an amount which can be up to 50% approximately relative to the total weight of the said detergent composition expressed as solids in the case of a dishwasher composition);
  - cogranulates of hydrated alkali metal silicates and of alkali metal (sodium or potassium) carbonates, described in EP-A-488 868, such as Nabion 15 sold by the company Rhodia (in an amount which can be up to 50% approximately relative to the total weight of the said detergent composition expressed as solids in the case of a dishwasher composition);

(the total amount of organic and/or inorganic "builders" possibly representing up to 90% of the total weight of the said detergent composition expressed as solids in the case of a dishwasher composition);

bleaching agents such as perborates or percarbonates, optionally combined with acetylated bleaching activators such as N,N,N',N'-tetraacetylethylenediamine (TAED) or chlorinated products such as chloroisocyanurates, or chlorinated products such as alkali metal hypochlorites, (in a proportion of from 0% to 30% relative to the total weight of the said detergent composition expressed as solids in the case of a dishwasher composition);

auxiliary cleaning agents such as copolymers of acrylic acid and of maleic anhydride or acrylic acid homopolymers (in a proportion of from 0% to 10% relative to the total weight of the said detergent composition expressed as solids in the case of a dishwasher composition);

fillers such as sodium sulphate or sodium chloride, in a proportion of from 0% to 50% relative to the total weight of the said composition, expressed as solids;

various other additives, for instance agents which have an influence on the pH of the detergent composition, in particular basifying additives that are soluble in the washing medium (phosphates of alkali metals, carbonates, perborates or hydroxides) or acidifying additives that are soluble in the washing medium (carboxylic or polycarboxylic acids, alkali metal bicarbonates and sesquicarbonates, phosphoric and polyphosphoric acids, sulphonic acids, etc.); or enzymes or fragrances, dyes or metal-corrosion inhibitors;

in particular for doing the washing-up by hand synthetic cationic polymers such as Mirapol A550 and Mirapol A15® sold by Rhodia, and Merquat 550® sold by Calgon, polymers used to control the viscosity of the mixture and/or the stability of the foams formed on use, such as cellulose or guar derivatives (carboxymethylcellulose, hydroxyethylcellulose, hydroxypropylguar, carboxymethylguar, carboxymethylhydroxypropyl guar, etc.), hydrotropic agents, such as $C_2$–$C_8$ short alcohols, in particular ethanol, doll and glycols such as diethylene glycol, dipropylene glycol, etc., moisturizers or wetting agents for the skin, such as glycerol or urea, or skin-protecting agents, such as proteins or protein hydrolysates, and cationic polymers such as cationic guar derivatives (Jaguar C13S®, Jaguar C162® and Hicare 1000® sold by the company Rhodia).

The compositions according to the invention can be diluted (in water) from 1 to 10,000 times, preferably from 1 to 1000 times, before use.

The cleaning composition according to the invention is applied to the surface to be treated in an amount such that it allows, where appropriate after rinsing, and after drying, a deposition of copolymer according to the invention of from 0.0001 g/m$^2$ to 1 g/m$^2$, preferably 0.001 g/m$^2$ to 0.1 g/m$^2$ of surface to be treated.

According to one particularly advantageous embodiment, the cleaning composition according to the invention is used for treating glass surfaces, in particular glass panels. This treatment can be carried out by the various known techniques. Mention may be made in particular of the techniques of cleaning glass panels by spraying them with a jet of water using devices of Karcher® type.

The amount of polymer introduced will generally be such that, during the use of the cleaning composition, after optional dilution, the concentration is between 0.001 g/l and 2 g/l, preferably from 0.005 g/l to 0.5 g/l.

Except where otherwise mentioned, the proportions are given on a weight basis.

The composition for cleaning glass panels according to the invention comprises:

from 0.001% to 10% and preferably from 0.005% to 3% by weight of at least one water-soluble or water-dispersible copolymer as defined above;

from 0.005% to 20% and preferably from 0.5% to 10% by weight of at least one nonionic (for example an amine oxide) and/or anionic surfactant; and the remainder being formed of water and/or various additives that are common in the field.

The cleaning formulations for glass panels comprising the said polymer can also contain:

from 0% to 10% and advantageously from 0.5% to 5% of amphoteric surfactant, from 0% to 30% and advantageously from 0.5% to 15% of solvent such as alcohols, and the remainder consisting of water and common additives (in particular fragrances).

The pH of the composition is advantageously between 6 and 11. The ratio a/b is preferably between 40/60 and 60/40.

The composition of the invention is also advantageous for doing the washing-up by hand or in an automatic machine. In this latter case, the said copolymer can be present either in the detergent formulation used in the washing cycle, or in the rinsing liquid.

Detergent formulations for doing the washing-up in automatic dishwashers advantageously comprise from 0.1% to 5% and preferably 0.2% to 3% by weight of water-soluble or water-dispersible copolymer relative to the total weight of solids in the composition.

The detergent dishwasher compositions also comprise at least one surfactant, preferably a nonionic surfactant, in an amount ranging from 0.2% to 10% and preferably from 0.5% to 5% relative to the weight of the said detergent composition expressed as solids, the remainder consisting of various additives and fillers, as already mentioned above.

The pH is advantageously between 8 and 12. The ratio a/b is preferably between 40/60 and 60/40.

Formulations for rinsing washing-up crockery in an automatic dishwasher advantageously comprise from 0.02% to 10% and preferably from 0.1% to 5% by weight of copolymer relative to the total weight of the composition.

They also comprise from 0.5% to 20% and preferably from 0.5% to 15% by weight, relative to the total weight of the said composition, of a surfactant, preferably a nonionic surfactant or a mixture of nonionic and anionic surfactant.

Among the preferred nonionic surfactants which may be mentioned are surfactants such as polyoxyethylenated $C_6$–$C_{12}$ alkylphenols, polyoxyethylenated and/or polyoxypropylenated $C_8$–$C_{22}$ aliphatic alcohols, ethylene oxide/propylene oxide block copolymers, optionally polyoxyethylenated carboxylic amides, etc.

They also comprise from 0% to 10% and preferably from 0.5% to 5% by weight, relative to the total weight of the composition, of a calcium-sequestering organic acid, preferably citric acid.

They can also comprise an auxiliary agent such as a copolymer of acrylic acid and of maleic anhydride or acrylic acid homopolymers, in a proportion of from 0% to 15% and preferably from 0.5% to 10% by weight relative to the total weight of the said composition.

The pH is advantageously between 4 and 7. The ratio a/b is preferably between 30/70 and 55/45.

A subject of the invention is also a cleaning composition for doing the washing-up by hand.

Preferred detergent formulations of this type comprise from 0.1 part to 5 parts by weight of copolymer of the invention per 100 parts by weight of the said composition and contain from 3 to 50 parts, preferably from 10 to 40 parts, by weight of at least one surfactant, preferably an anionic surfactant, chosen in particular from saturated $C_5$–$C_{24}$, preferably C10–$C_{16}$, aliphatic alkyl sulphates, optionally condensed with approximately 0.5 mol to 30 mol, preferably 0.5 mol to 5 mol and most particularly 0.5 mol to 3 mol, of ethylene oxide, in acid form or in the form of a salt, in particular an alkali metal (sodium), alkaline-earth metal (calcium, magnesium), etc. salt.

The present invention is directed more particularly towards foaming liquid aqueous detergent formulations for doing the washing-up by hand.

The said formulations can also contain other additives, in particular other surfactants, such as:

- nonionic surfactants such as amine oxides, alkylglucamides, oxyalkylenated derivatives of fatty alcohols, alkylamides, alkanolamides and amphoteric or zwitterionic surfactants
- non-cationic bactericides or disinfectants such as triclosan
- synthetic cationic polymers
- polymers for controlling the viscosity of the mixture and/or the stability of the foams formed on use
- hydrotropic agents
- moisturizers or wetting agents or skin protectors
- dyes, fragrances, preserving agents, etc. as already mentioned above.

The pH of the composition is advantageously between 6 and 8. The ratio a/b is preferably between 40/60 and 60/40.

Another subject of the invention consists in a cleaning composition for external cleaning, in particular of the bodywork, of motor vehicles.

In this case also, the copolymer according to the invention can be present either in a detergent formulation used for the washing operation, or in a rinsing product.

The cleaning composition for motor vehicles advantageously comprises from 0.05% to 5% by weight of copolymer according to the invention relative to the total weight of the said composition, as well as:

- nonionic surfactants (in a proportion of from 0% to 30% and preferably from 0.5% to 15% of the formulation),
- amphoteric and/or zwitterionic surfactants (in a proportion of from 0% to 30% and preferably from 0.5% to 15% of the formulation)
- cationic surfactants (in a proportion of from 0% to 30% and preferably from 0.5% to 15% of the formulation);
- anionic surfactants (in a proportion of from 0% to 30% and preferably from 0.5% to 15% of the formulation);
- organic or inorganic detergent adjuvants ("builders");
- hydrotropic agents;
- fillers, pH regulators, etc.

The minimum amount of surfactant present in this type of composition can be at least 1% of the formulation.

The pH is advantageously between 8 and 12. The ratio a/b is preferably between 40/60 and 60/40.

The composition of the invention is also particularly suitable for cleaning hard surfaces other than those described above, in particular ceramics (tiles, baths, sinks, etc.).

In this case, the cleaning formulation advantageously comprises from 0.02% to 5% by weight of copolymer relative to the total weight of the said composition, as well as at least one surfactant.

Surfactants that are preferred are nonionic surfactants, in particular the compounds produced by condensation of alkylene oxide groups such as described above which are of hydrophilic nature with a hydrophobic organic compound which may be of aliphatic or alkyl aromatic nature.

The length of the hydrophilic chain or of the polyoxyalkylene radical condensed with any hydrophobic group may easily be adjusted to obtain a water-soluble compound which has the desired degree of hydrophilic/hydrophobic balance (HLB).

The amount of nonionic surfactants in the composition of the invention is generally from 0% to 30% by weight and preferably from 0% to 20% by weight.

An anionic surfactant may optionally be present in an amount of from 0% to 30% and advantageously 0% to 20% by weight.

It is also possible, but not obligatory, to add amphoteric, cationic or zwitterionic detergents to the composition of the present invention for cleaning hard surfaces.

The total amount of surfactant compounds used in this type of composition is generally between 1.5% and 50% and preferably between 5% and 30% by weight, and more particularly between 10% and 20% by weight, relative to the total weight of the composition.

The composition for cleaning hard surfaces of the present invention can also contain other minor ingredients which are cleaning additives.

For example, the composition can contain organic or inorganic detergent adjuvants ("builders") as mentioned above.

The detergent adjuvant is generally used in an amount of between 0.1% and 25% by weight relative to the total weight of the composition.

Another optional ingredient in the compositions for cleaning hard surfaces of the invention is a foam regulator, which can be used in compositions which have a tendency to produce an excess of foam during their use. One example of these materials is soaps. Soaps are salts of fatty acids and comprise alkali metal soaps, in particular the sodium, potassium, ammonium and alkanolammonium salts of higher fatty acids containing from about 8 to 24 carbon atoms, and preferably from about 10 to about 20 carbon atoms. The salts of mono-, di- and triethanolamine, of sodium and of potassium or of mixtures of fatty acids derived from coconut oil and from ground walnut oil are particularly useful. The amount of soap may be at least 0.005% by weight, preferably from 0.5% to 2% by weight, relative to the total weight of the composition. Additional examples of foam regulators are organic solvents, hydrophobic silica, silicone oil and hydrocarbons.

The compositions for cleaning hard surfaces of the present invention can also contain, besides the ingredients mentioned above, other optional ingredients such as pH regulators, dyes, optical brighteners, soil-suspending agents, detergent enzymes, compatible bleaching agents, gel-formation regulators, freezing-thawing stabilizers, bactericides, preserving agents, solvents, fungicides, insect repellents, hydrotropic agents, fragrances and opacifiers or pearlescent agents.

The pH of the composition is advantageously between 3 and 11. The ratio a/b is preferably-between 30/70 and 60/40.

The composition of the invention can also be used for cleaning toilet pans.

One composition which is particularly suitable for this purpose comprises from 0.05% to 5% by weight of copolymer according to the invention, having a ratio a/b between 25/75 and 50/50.

The composition for cleaning toilet pans according to the invention also comprises an acidic cleaning agent which can consist of an inorganic acid such as phosphoric acid, sulphamic acid, hydrochloric acid, hydrofluoric acid, sulphuric acid, nitric acid or chromic acid and mixtures thereof, or an organic acid, in particular acetic acid, hydroxyacetic acid, adipic acid, citric acid, formic acid, fumaric acid, gluconic acid, glutaric acid, glycolic acid, malic acid, maleic acid, lactic acid, malonic acid, oxalic acid, succinic acid and tartaric acid, as well as mixtures thereof, and acid salts such as sodium bisulphate, and mixtures thereof.

The amount of acidic ingredients is preferably between 0.1% and about 40% and preferably between 0.5% and about 15% by weight relative to the total weight of the composition.

The preferred amount depends on the type of acidic cleaning agent used: for example, with sulphamic acid. It is between about 0.2% and about 1%, with hydrochloric acid it is between about 1% and about 5%, with citric acid it is between about 2% and about 10%, Awith formic acid it is between about 5% and about 15%, and with phosphoric acid it is between about 5% and about 30% by weight.

The amount of acidic agent is generally such that the final pH of the composition is from about 0.5 to about 4, preferably 1 to 3.

The cleaning composition for toilet pans also comprises from 0.5% to 10% by weight of a surfactant so as to contribute towards removing soiling or so as to give foaming or wetting properties or alternatively to enhance the cleaning efficacy of the composition. The surfactant is preferably an anionic or nonionic surfactant.

Cationic surfactants can also be added to the composition for cleaning toilet pans according to the invention, in order to provide germicidal properties. A person skilled in the art will see that amphoteric surfactants can also be used. Mixtures of various surfactants can be used, if so desired.

The composition for cleaning toilet pans according to the invention can also comprise a thickener such as a gum, in particular a xanthan gum introduced at a concentration of from 0.1% to 3%, as well as one or more of the following minor ingredients: a preserving agent intended to prevent the growth of microorganisms in the product, a dye, a fragrance and/or an abrasive agent.

The composition according to the invention is also suitable for rinsing the walls of showers.

The aqueous compositions for rinsing the walls of showers comprise from 0.02% to 5% by weight and advantageously from 0.05% to 1% of the copolymer of the invention.

The other main active components of the aqueous compositions for rinsing showers of the present invention are at least one surfactant present in an amount ranging from 0.5% to 5% by weight and optionally a metal-chelating agent present in an amount ranging from 0.01% to 5% by weight.

The preferred metal-chelating agents are ethylenediaminetetraacetic acid (EDTA) and its analogues.

The aqueous compositions for rinsing showers advantageously contain water, optionally with at least one lower alcohol in a majority proportion and additives in a minority proportion (between about 0.1% and about 5% by weight, more advantageously between about 0.5% and about 3% by weight and even more preferably between about 1% and about 2% by weight).

Certain surfactants which can be used in this type of application are described in U.S. Pat. Nos. 5 536 452 and 5 587 022, the content of which is incorporated by reference in the present description.

Preferred surfactants are polyethoxylated fatty esters, for example polyethoxylated sorbitan monooleates and polyethoxylated castor oil. Specific examples of such surfactants are the products of condensation of 20 mol of ethylene oxide and of sorbitan monooleate (sold by Rhodia Inc. under the name Alkamuls PSMO-200 with an HLB of 15.0) and 30 mol or 40 mol of ethylene oxide and of castor oil (sold by Rhodia Inc. under the name Alkamuls EL-62009 (HLB of 12.0) and EL-719® (HLB of 13.6), respectively). The degree of ethoxylation is preferably sufficient to obtain a surfactant with an HLB of greater than 13. Other surfactants such as alkylpolyglucosides are also highly suitable for these compositions.

The pH of the composition is advantageously between 7 and 11. The ratio a/b is preferably between 40/60 and 60/40.

The composition according to the invention can also be used for cleaning glass-ceramic plates.

The formulations for cleaning glass-ceramic plates of the invention advantageously comprise:

0.1% to 5% by weight of the copolymer of the invention;

0.1% to 1% by weight of a thickener such as a xanthan gum;

10% to 40% by weight of an abrasive agent such as calcium carbonate or silica;

0% to 7% by weight of a glycol such as butyl diglycol;

1% to 10% by weight of a nonionic surfactant;

0.1% to 3% by weight of a copolymer of silicone type; and optionally, basifying agents or sequestering agents.

The pH of the composition is advantageously between 7 and 12. The ratio a/b is preferably between 40/60 and 60/40.

A subject of the invention is also the use, in a composition for cleaning a hard surface, of at least one water-soluble or water-dispersible copolymer comprising, in the form of polymerized units:

(a) at least one monomeric compound of general formula I:

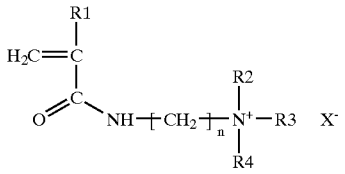

in which $R_1$ is a hydrogen atom or a methyl group, preferably a methyl group;

$R_2$, $R_3$ and $R_4$ are linear or branched $C_1$–$C_4$ alkyl groups;

n represents an integer from 1 to 4, in particular the number 3;

X represents a counterion which is compatible with the water-soluble or water-dispersible nature of the polymer;

(b) at least one hydrophilic monomer chosen from $C_3$–$C_8$ carboxylic acids containing monoethylenic unsaturation, anhydrides thereof and water-soluble salts thereof;

(c) optionally at least one hydrophilic monomeric compound containing ethylenic unsaturation, of neutral charge, bearing one or more hydrophilic groups, which is copolymerizable with (a) and (b);

the average charge Q on the polymer defined by the equation:

$$Q = \frac{[a] - [b]\Gamma}{[a]}$$

in which [a] represents the molar concentration of monomer (a);

in which [b] represents the molar concentration of monomer (b); and and r represents the rate of neutralization of monomers (b) defined by:

$$\Gamma = \frac{[COO^-]}{[COOH] + [COO^-]}$$

in which [COOH] and [$COO^-$] represent, respectively, the molar concentrations of monomers (b) in carboxylic acid and carboxylate form at the pH at which the cleaning composition is used, being greater than 0 and possibly going down to 0.4, advantageously down to 0.2, in order to give hydrophilic properties to the hard surface onto which it has been applied.

The molar ratio (a)/(b) is advantageously between 25/75 and 70/30.

The molar ratio (c)/(a+b+c) is advantageously between 0 and 40/100, preferably between 10/100 and 30/100.

The hydrophilic properties given by the copolymer of the invention are, in particular, "run- resistance", "anti-misting", "stain-resistance" and/or "mark-resistance" properties.

A subject of the invention is also the use, in a liquid cleaning composition for a hard surface, of at least one water-soluble or water-dispersible copolymer of general formula I given above, as an agent for reducing the drying speed of the surface onto which the said liquid composition has been applied.

A subject of the invention is similarly a process for improving the hydrophilicity of a hard surface, by treating the said surface using a cleaning composition comprising at least one copolymer of general formula I given above.

A subject of the invention is also a process for improving the drying speed of a hard surface after it has been cleaned with a cleaning composition, by incorporating at least one copolymer of general formula I given above into the said composition.

The examples below are intended to illustrate the invention.

EXAMPLE 1

An acrylic acid/MAPTAC/acrylamide copolymer with a 40/40/20 molar ratio is prepared in a manner which is known per se. Its weight-average molecular mass is about 2,000,000.

Two detergent solutions are prepared, each containing a concentration of 50 ppm of polymer and 0.2 g/l of nonionic surfactant Symperonic A7 from BASF and whose pH is adjusted by adding 0.01 molar sodium hydroxide. The transmittance of the solution is measured using a photometer. The charge of the polymer is determined by assaying with a poly(potassium vinyl sulphate) solution.

Each aqueous solution is sprayed onto a black ceramic tile, placed upright. After drying the ceramic tile, pure water is sprayed onto the surface. The flow of water at the surface of the ceramic is observed visually.

The results obtained are given in the table below:

| | Solution 1 (comparative example) | Solution 2 |
|---|---|---|
| pH | 4 | 9 |
| Charge of the polymer | 0.6 | 0.05 |
| Transmittance | 100 | 86 |
| Visual observation | Heterogeneous flow of the film of water | Homogeneous flow of the film of water |

This result shows that solution 1 of polymer with a low pH and consequently a high average charge does not make it possible to obtain an effective benefit in terms of surface hydrophilization. On the other hand, the polymer having a very low charge (solution 2) as defined in the invention leads to an effective surface hydrophilization.

EXAMPLES 2 to 4

Evaluation Method

A glass surface consisting of microscope slides 2.5×7.5 cm in size, precleaned with ethanol, is used, the composition of which slides is given below:

| | |
|---|---|
| Si | 21–43% by weight |
| Ca | 2.8–5.8% by weight |
| Mg | 1.6–3.4% by weight |
| Na | 6.8–14.2% by weight |
| Al | 0.3–0.7% by weight |

Detergent solutions are prepared, each containing a concentration of 50 ppm of polymer of Example 1 (acrylic acid/MAPTAC/acrylamide copolymer with a 40/40/20 molar ratio), 0.2 g/l of nonionic surfactant Symperonic A7 from BASF and 1 mol/l of KCl salt, and whose pH is adjusted by adding 0.01 molar sodium hydroxide.

The solution of polymer is deposited on a glass slide using a centrifugal applicator with:

deposition of the solution of polymer onto the glass slide;

rotation of the glass slide at 1500 rpm for 30 seconds.

A contact angle measurement can then be carried out on the treated slide in order to obtain a so-called "without rinsing" result. The so-called "with rinsing" result requires the following additional steps:

immersing the glass slide in purified water for 15 seconds;

drying the slide by rotation with the rotary applicator, for 30 seconds at 1500 rpm.

The contact angle between the water and the treated glass is measured on a Ram6-Hart assembly and is expressed in degrees. Eight to ten measurements are taken per glass slide. Two to three glass slides are prepared for each polymer and the results thus correspond to the average of 20 to 30 measurements.

The contact angle obtained on a slide which has undergone the treatment described with an aqueous solution (demineralized water) without polymer gives a contact angle of 31.7±10.

The values before rinsing give information regarding the hydrophilic or hydrophobic nature of the polymer. However, the most interesting data corresponds to the contact angle after rinsing, which characterizes both the hydrophilicity and the force of the polymer/glass interactions. For the application in cleaning hard surfaces, a low value of this contact angle with rinsing is desired. A polymer with a contact angle of less than 200 and most particularly less than 15° will give good performance qualities when used.

The polymers studied and the results obtained are given in the table below:

| Examples | pH of the polymer solution | Contact angle before rinsing | Contact angle after rinsing | Charge of the polymer |
|---|---|---|---|---|
| 2 (comparative) | 4 | 24 | 25 | 0.60 |
| 3 | 7 | 22 | 20 | 0.17 |
| 4 | 9 | 18 | 16 | 0.05 |

EXAMPLES 5 and 6

The method of Examples 2 to 4 is used with solutions of polymers in demineralized water at a concentration of 0.5 g/l and on ceramic tiles having a surface similar to that of toilet pans. The pH of these solutions is 3.8. At this pH, the degree of deprotonation of the acrylic acid in the polymer is 30%. This value makes it possible to calculate the charge Q on the polymers studied.

With these higher polymer concentrations, it is considered that a good application result corresponds to a contact angle of less than 15°.

Polymers having the general structure below are evaluated:

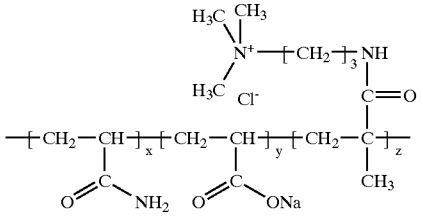

The table below gives the results obtained:

| Examples | x mol % | y mol % | z mol % | Charge Q | Angle before rinsing | Angle after rinsing |
|---|---|---|---|---|---|---|
| 5 (comparative) | 20 | 20 | 60 | 0.9 | 20.45 | 24.1 |
| 6 | 20 | 60 | 20 | 0.1 | 11.2 | 14.5 |

These results show that large hydrophilization of the ceramic tiles is obtained only when the charge on the polymer is low.

EXAMPLE 7

An aqueous solution is prepared containing 0.5 g/l of nonionic surfactant Symperonic A7 from BASF and 0.2 g/l of acrylic acid/MAPTAC/acrylamide copolymer with a 40/40/20 molar ratio in a hard water containing 300 ppm of $CaCO_3$. This solution has a pH of 7.

This solution is used to treat a ceramic tile. This tile is placed upright and the treatment is carried out as follows:

spraying of the detergent solution in order to wet all of the tile;

drying for 2 minutes;

rinsing by spraying with hard water containing 300 ppm of $CaCO_3$;

drying for two hours.

The tile thus treated is placed on a balance which is accurate to within $10^{-2}$ g and 24 drops of water of 3 $\mu$l each are placed on the tile using a multichannel micropipette.

The drying time of the tile is evaluated by the variation in mass, and in particular the time required for 90% of the water to evaporate is noted.

The tile treated with a simple surfactant solution requires a 90% drying time of 17 minutes.

The tile treated with the solution of polymer and of surfactant requires a 90% drying time of 12 minutes.

This result shows that the polymer brings about a rapid drying of hard surfaces.

EXAMPLES 8 to 10

Cleaning formulations for Cleaning Glass Panels

The table below gives the composition of three cleaning formulations used for cleaning glass panels; the test of hydrophilization of glass by contact angle described for Examples 2 to 4 is used directly with the detergent formulation without dilution. As in Examples 2 to 4, the glass slide is rinsed with pure water after the detergent solution has been applied.

| Components | Formulations | | |
|---|---|---|---|
| | A (by weight) | B (by weight) | C (by weight) |
| Isopropyl alcohol | 7 | 15 | 7 |
| Ethoxylated (7EO) fatty alcohol (C12) | 0 | 3 | 0 |
| Sodium dodecylbenzene sulphonate | 0.5 | 0 | 0.5 |
| Ammonium hydroxide | 0.3 | 0.3 | 0.3 |
| Dipropylene glycol monomethylether | 0.25 | 0.5 | 0.25 |
| Copolymer of Example 1 | 0.05 | 0.5 | 0.0 |
| Water | qs 100 | qs 100 | qs 100 |
| pH of the formulation | 7 | 7 | 7 |
| Charge of the polymer Q | 0.15 | 0.15 | / |
| Contact angle | 21 | 15 | 28 |

The contact angle results obtained on formulations A and B (in comparison with formulation (C) show that this polymer brings about, in the formulation, a long-lasting hydrophilization of the glass surface.

Formulations A and B are used in neat form by spraying onto the surface of the glass panels to be cleaned (6 to 8 sprays, i.e. 3 to 5 g of formulation per m2 of surface area).

EXAMPLES 11 and 12

Cleaning formulations for Hard Surfaces Such as Tiles

The table below gives cleaning formulations for cleaning hard surfaces. The test of hydrophilization of glass by contact angle described for Examples 2 to 4 is used with the detergent formulation after dilution. As in Examples 2 to 4, the glass slide is rinsed with pure water after the detergent solution has been applied.

| Components | Formulations D (by weight) | E (by weight) |
|---|---|---|
| Ethoxylated (7EO) fatty alcohol (C12) | 6 | 8 |
| Sodium alkane (C12) sulphonate | 3 | 2 |
| Sodium hydroxide | such that pH = 10.4 | such that pH = 10.4 |
| Copolymer of Example 1 | 0 | 1 |
| Water | qs 100 | qs 100 |
| Charge of the polymer Q | / | 0.05 |
| Contact angle (°) | 28 | 16 |

Formulations D and E are diluted before use, at a rate of 10 g of formulation in 1 litre of water.

Example D is given for comparative purposes. The contact angle results obtained on formulations D and E show that the polymer brings about, in the formulation, a long-lasting hydrophilization of the glass surface.

EXAMPLES 13 to 16

Detergent Formulations for an Automatic Dishwasher

A test of hydrophilization of glass by contact angle is carried out under the following conditions:

The glass slides are placed in an automatic dishwasher and a 32 g dose of the detergent powder formulation is placed in the reservoir intended for this purpose. No rinsing liquid is used in this test. These glass slides are washed using the "normal" programme, which gives a maximum washing temperature of 65° C. At the end of the washing operation, the dishwasher is kept closed for 3 hours.

The hydrophilicity of the glass slides thus treated is then characterized by the contact angle technique described in Examples 2 to 4.

| Formulation example | Example 13 | Example 14 | Example 15 | Example 16 |
|---|---|---|---|---|
| Sodium tripolyphosphate | 0 | 45 | 0 | 45 |
| Sodium carbonate | 30 | 20 | 30 | 20 |
| Sodium disilicate | 15 | 10 | 15 | 10 |
| Sodium citrate | 20 | 0 | 20 | 0 |
| Sodium sulphate | 12 | 8 | 14 | 10 |
| Poly(sodium acrylate) CP5 from BASF | 6 | 0 | 6 | 0 |
| Plurafac LF 403 | 2 | 2 | 2 | 2 |
| Bleaching system (perborate monohydrate + TAED**) | 10 | 10 | 10 | 10 |
| Other additives (including benzotriazole, enzymes, fragrance) | 3 | 3 | 3 | 3 |
| Polymer of Example 1 | 2 | 2 | 0 | 0 |
| pH | 10.5 | 10.4 | 10.5 | 10.4 |
| Charge of the polymer Q | 0.05 | 0.05 | / | / |
| Contact angle | 13 | 12 | 24 | 22 |

**ethylenediamine tetraacetate

Examples 16 and 17 are given for comparative purposes. The contact angle results obtained with formulations 14 and 15 show that the polymer brings about, in the formulation, a long-lasting hydrophilization of the glass surface in a dishwasher, which does not occur with the comparative examples.

EXAMPLES 17 to 19

Formulations for Rinsing Washing-up Crockery in an Automatic Dishwasher

An evaluation similar to that given in Examples 13 to 16 is carried out for the rinsing liquid. This test is carried out with the detergent powder of Example 15 and with the rinsing liquids mentioned below.

| Formulation | Example 17 | Example 18 | Example 19 |
|---|---|---|---|
| Nonionic surfactant C13-3PO-7EO (EO/PO linear fatty alcohol) | 12 | 12 | 12 |
| Citric acid | 3 | 3 | 3 |
| Polymer of Example 1 | 0 | polymer (1%) | polymer (2%) |
| Water | qs 100 5 | qs 100 5 | qs 100 5 |
| Charge of the polymer Q | / | 0.30 | 0.30 |
| Contact angle | 24 | 16 | 15 |

Example 17 is given for comparative purposes.

The contact angle results obtained for formulations 18 and 19 show that the polymer brings about, in the formulation, a long-lasting hydrophilization of the surface of glass in a dishwasher, which does not occur with the formulation of Example 17.

EXAMPLES 20 to 22

Formulation for Doing Washing-up by Hand

The test of glass hydrophilization by contact angle described for Examples 2 to 4 is used with the detergent formulation after dilution to 1 g/l. As in Examples 2 to 4, the glass slide is rinsed with pure water after the detergent solution has been applied.

| Formulation | Example 20 | Example 21 | Example 22 |
|---|---|---|---|
| Sodium alkyl (C14) sulphonate | 24 | 24 | 12 |
| Ethoxylated C12 fatty alcohol - 1.5 EO | 5 | 5 | 3 |
| Ethoxylated C10 fatty alcohol - 7 EO | 4 | 4 | 4 |
| Polymer of Example 1 | 0 | polymer (2%) | polymer (2%) |
| Water | qs 100 | qs 100 | qs 100 |
| pH | 7 | 7 | 7 |
| Charge of the polymer Q | / | 0.15 | 0.15 |
| Contact angle | 28 | 19 | 15 |

Example 20 is given for comparative purposes.

The contact angle results obtained for formulations 21 and 22 show that the polymer brings about, in the formulation, a long-lasting hydrophilization of the surface of glass in a dishwasher, this property not being found with the formulation of Example 20.

EXAMPLES 23 to 25

Detergent Formulations for Cleaning Hard Surfaces (Tiles, Sinks, Baths)

The test of glass hydrophilization by contact angle described for Examples 2 to 4 is used with the detergent formulation after dilution to 1 g/l, but it is carried out on black ceramic tiles. As in Examples 2 to 4, the support is rinsed with pure water after the detergent solution has been applied.

| Formulation | Example 23 | Example 24 | Example 25 |
|---|---|---|---|
| Sodium alkyl (C12) sulphonate | 12 | 24 | 12 |
| Ethoxylated C12 fatty alcohol - 6 EO | 5 | 5 | 3 |
| Ethanol | 2 | 4 | 4 |
| Polymer of Example 1 | 0 | polymer (2%) | polymer (2%) |
| Water | qs 100 | qs 100 | qs 100 |
| pH | 7 | 7 | 7 |
| Charge of the polymer Q | / | 0.15 | 0.15 |
| Contact angle | 35 | 19 | 16 |

Example 23 is given for comparative purposes.

The contact angle results obtained with formulations 24 and 25 show that the polymer brings about, in the formulation, long-lasting hydrophilization of hard surfaces, this property not being found with the formulation of example 23.

What is claimed is:

1. A cleaning composition for hard surfaces, comprising at least one surfactant and at least one water-soluble or water-dispersible copolymer of the formula:

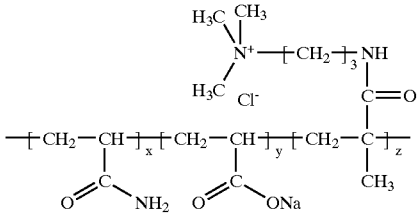

wherein the sum of x+y+z is equal to 100%, x, y and z representing the molar percentages of units derived, respectively, from acrylamide, from acrylic acid and from MAPTAC in the copolymer, the ratio y/z is from 25/75 to 70/30, and x is between 10% and 40%.

2. The cleaning composition according to claim 1, wherein the molecular mass of the copolymer is at least 10,000, and not more than 10,000,000.

3. The cleaning composition according to claim 1, wherein said water-soluble or water-dispersible copolymer represents from 0.001% to 10% of the total weight of said composition.

4. The cleaning composition according to claim 1, wherein the water-soluble or water-dispersible copolymer/surfactant weight ratio is between 1/5 and 1/50.

5. A cleaning composition for cleaning window panes, comprising:

from 0.001% to 10% by weight, of at least one water-soluble or water-dispersible copolymer comprising in the from of polymerized units:

(a) at least one monomer compound of general formula I:

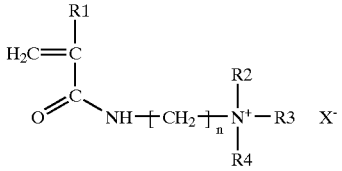

wherein $R_1$ is a hydrogn atom or a methvl group, $R_2$, $R_3$ are linear or branched $C_1$–$C_4$ alkyl groups n represents an integer from 1 to 4:

X represents a counterion which is compatible with the water-soluble or water-dispersible nature of the polymer, (b) at least one hydrophilic monomer chosen from $C_3$–$C_8$ carboxvlic acids containing monoethylenic unsaturation, their anhydrides and their water-soluble salts;

(c) optionally at least one hydrophilic monomer compound containing ethylenic unsaturation, of neutral chare bearing one or more hydrophilic groups which is copolymerizable with (a) and (b);

the average charge Q of the polymer being defined by the equation:

$$Q = [a] - [b]\tilde{A}$$

$$[a]$$

wherein (a) represents the molar concentration of monomer (a);

wherein [a] represents the molar concentration of monomer (a); and $\tilde{A}$ represents the degree of neutralization of the monomers (b) defined by:

$$\tilde{A} = [COO^-]$$

$$[COOH] + [COO^-]$$

wherein [COOH] and [COO] represent, respectively, the molar concentrations of monomers (b) in carboxylic acid form and in carboxylate form at the working pH of the cleaning composition, being greater than 0 and ranging up to 0.4; and said composition presenting a copolymer of formula I/surfactant weight ratio of between 1/2 and 1/100.

from 0.005% to 20% by weight, of at least one nonionc and/or anionic surfactant;

the remainder being formed of water, solvents, or various additives; and having a pH of between 6 and 11 and a molar ratio a/b of between 40/60 and 60/40, and an amine oxide as nonionic surfactant.

6. A cleaning composition for cleaning toilet bowls, comprising:

from 0.05% to 5% by weight relative to the total weight of said composition, of a water-soluble or water-dispersible copolymer comprising, in the form of polymerized units:

(a) at least one monomer compound of general formula I:

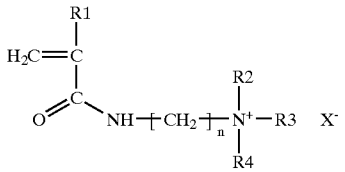

wherein $R_1$ is a hydrogen atom or a methyl group;

$R_2$, $R_3$ and $R_4$ are linear or branched $C_1$–$C_4$ alkyl groups;

n represents an integer from 1 to 4;

X represents a counterion which is compatible with the water-soluble or water-dispersible nature of the polymer;

(b) at least one hydrophilic monomer chosen from $C_3$–$C_8$ carboxylic acids containing monoethylenic unsaturation, their anhydrides and their water-soluble salts;

(c) optionally at least one hydrophilic monomer compound containing ethylenic unsaturation, of neutral charge, bearing one or more hydrophilic groups, which is copolymerizable with (a) and (b);

the average charge Q of the polymer being defined by the equation:

$$Q = \frac{[a] - [b]\tilde{A}}{[a]}$$

wherein [a] represents the molar concentration of monomer (a);

wherein [b] represents the molar concentration of monomer (b); and $\tilde{A}$ represents the degree of neutralization of the monomers (b) defined by:

$$\tilde{A} = \frac{[COO^-]}{[COOH] + [COO^-]}$$

wherein [COOH] and $[COO^-]$ represent, respectively, the molar concentrations of monomers (b) in carboxylic acid form and in carboxylate form at the working pH of the cleaning composition, being greater than 0 and ranging up to 0.4; and said composition presenting a copolymer of formula I/surfactant weight ratio of between 1/2 and 1/100;

from 0.1% to 40% by weight, relative to the total weight of the composition, of an inorganic-acid cleaning agent which is phosphoric acid, sulphamic acid, hydrochloric acid, hydrofluoric acid, sulphuric acid, nitric acid or chromic acid or an organic acid, which is acetic acid, hydroxyacetic acid, adipic acid, citric acid, formic acid, fumaric acid, gluconic acid, glutaric acid, glycolic acid, malic acid, maleic acid, lactic acid, malonic acid, oxalic acid, succinic acid or tartaric acid or an acid salt which is sodium bisulphate;

from 0.5% to 10% by weight of a surfactant;

from 0. 1% to 3% by weight of a thickener; and additives:

said composition having a pH of between 0.5 and 4 and a molar ratio a/b of between 25/75 and 50/50.

* * * * *